United States Patent [19]

Baird

[11] Patent Number: 4,705,239

[45] Date of Patent: Nov. 10, 1987

[54] TOY PARACHUTE

[76] Inventor: Eric A. Baird, 137 Sixth St. Rm 2, New Toronto, Canada, M8V 3A6

[21] Appl. No.: 897,269

[22] Filed: Aug. 18, 1986

[51] Int. Cl.[4] ..... B64C 31/06

[52] U.S. Cl. ..... 244/155 R

[58] Field of Search ..... 244/155 R, 153 R; 446/49, 50

[56] References Cited

U.S. PATENT DOCUMENTS

| | | | |
|---|---|---|---|
| 2,471,199 | 5/1949 | Coyne et al. | 244/155 R |
| 2,950,887 | 8/1960 | Hidding | 244/155 R |
| 4,074,877 | 2/1978 | Hayenga | 244/155 R |

*Primary Examiner*—Jeffrey V. Nase

*Assistant Examiner*—Lynn M. Fiorito

*Attorney, Agent, or Firm*—Riches, McKenzie & Herbert

[57] ABSTRACT

A toy parachute is disclosed for attachment to a kite string and for after travelling up the string and contacting stop means being released from the string for free flight to the ground. The toy includes a carrier which is slidable up and down the kite string coaxially disposed thereabout. The parachute is releasably coupled to the carrier by a novel split sleeve member having a central aperature into which the upper end of the carrier may be inserted. The split sleeve member has a major slot throughout its length which permits the kite string to pass therethrough on uncoupling of the split sleeve from the carrier so as to release the parachute toy from the kite string.

10 Claims, 6 Drawing Figures

FIG.4.
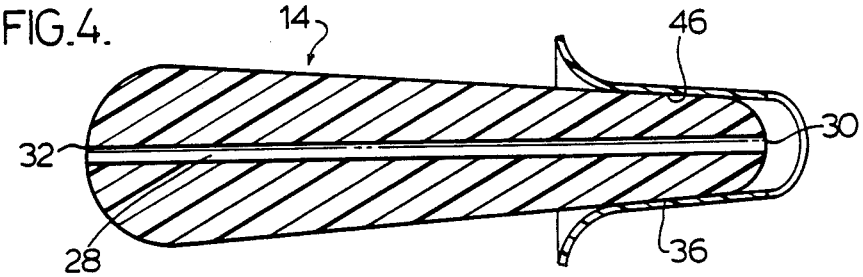
FIG.5.
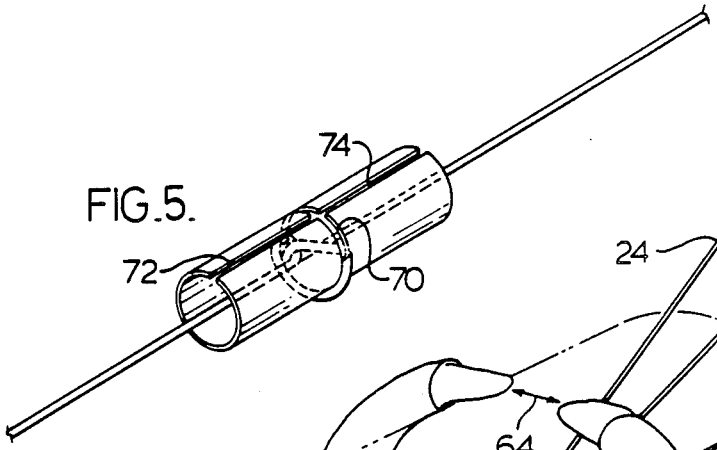
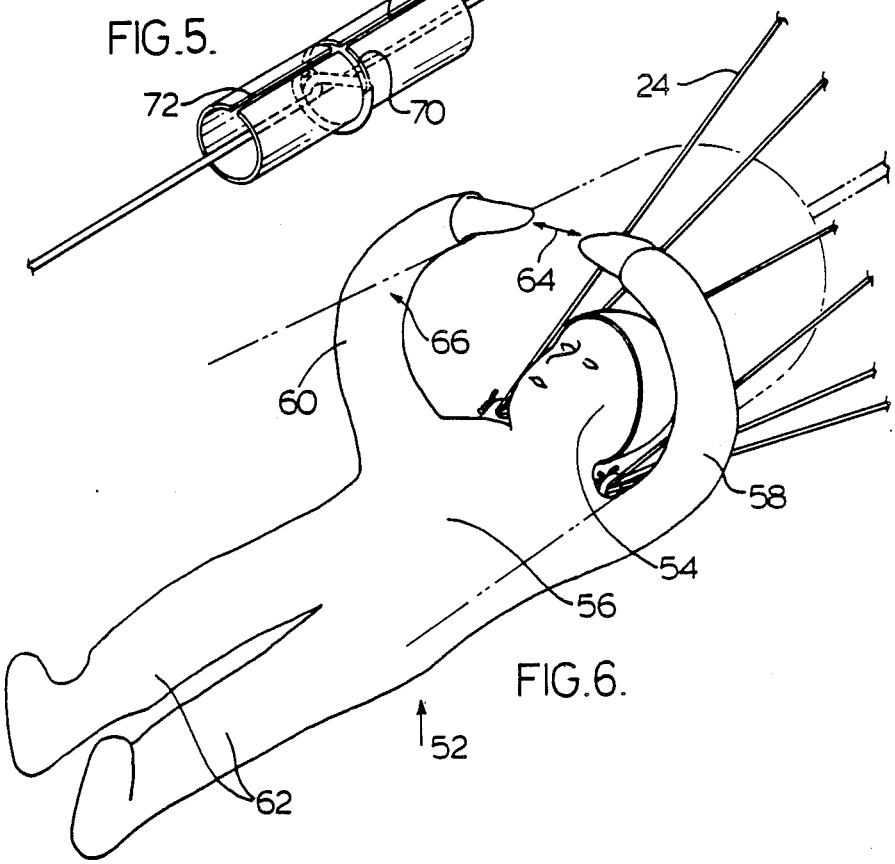
FIG.6.

TOY PARACHUTE

FIELD OF THE INVENTION

This invention relates to toy parachutes and more particularly to a parachute toy which may be used in conjunction with a conventional kite for sending a parachute up the kite string and for releasing such parachute at a predetermined point on the kite string.

BACKGROUND OF THE INVENTION

A number of such toy parachute devices are known. These include the toys taught by the following U.S. Pat. Nos.

2,598,030—H. LE M. Bird;
2,927,753—M. H. Feldman;
2,936,545—C. R. Enterkin;
3,109,257—W. B. Curtis;
3,332,645—W. C. Hansen;
3,513,591—W. C. Hansen;
4,424,643—Tilghman.

The devices taught by these patents suffer disadvantages that the means by which the toys engage the kite string for sliding up the kite string and the means by which the parachute is released from the kite string do not provide for simple, efficient operation.

Most of the patents suffer from a disadvantage that the sliding coupling between with kite string is inadequate. For example, the paper string engaging devices of the two Hansen patents and the ring in Enterkin do not facilitate smooth sliding up the kite string. The link of Hansen U.S. Pat. No. 3,513,591 and the ring in Enterkin do not readily slide back down the kite string. The wheeled runners of Feldman and Tilghman readily become disengaged from the string in gusty wind conditions.

The devices from these patents suffer the disadvantages that they do not lend themselves to closely mimicing the appearance of a human parachute. For example, in the device of Bird the rather complex release mechanism requires a ball coupled to the parachute to be released from engagement in both first and second sleeves. Provision of this ball makes it difficult to closely mimic the appearance of a human parachute.

SUMMARY OF THE INVENTION

Accordingly, it is an object of the present invention to at least partially overcome the disadvantages of these previously known devices by providing a toy incorporating a split sleeve member which permits coupling of a parachute to a carrier member slidable on a kite string yet with the coupled carrier member and split sleeve member both substantially coaxially about the kite string.

Another object is to provide a simple construction for a parachute toy to ascend a kite string which may be manufactured at low cost yet provide efficient operation.

Another object is to provide a construction for a toy parachute which can closely mimic the appearance of a real parachuter.

In a first of its aspects the present invention provides a parachute toy for being attached to a kite string and for, after travelling up said string with the wind, being released from said string for free flight to the ground, said toy comprising:

weight means, a parachute having a canopy and a plurality of shroud lines, the shroud lines being separately attached to said canopy at their upper ends and attached to the weight means at their lower ends, carrier means having an elongate opening centrally therethrough to receive said kite string therein so that the carrier means is slidable up and down the kite string, the carrier means having at an upper end thereof an outer engagement surface disposed substantially coaxially about the opening, the weight means including a split sleeve member coupled thereto with an aperature centrally through the split sleeve member open at an upper end and at a lower end, a major slot through the sleeve member opening into the aperature throughout its length from said upper end to the lower end, internal engagement surfaces on the split sleeve member defining the aperature, the split sleeve member adapted to releasably couple to the carrier means coaxially thereabout by insertion of the upper end of the carrier means into the lower end of the aperature so that the coupled carrier means and split sleeve member as a unit may slide on the kite string disposed thereabout, the slot permitting passage of the kite string into the aperature in coupling of the split sleeve member to the carrier means and out of the aperature on uncoupling of the split sleeve member from the carrier means, and stop means for attachment to the kite string at a desired height above the carrier means sized to arrest upward movement of the carrier means yet permit upward movement of the split sleeve member therepast.

In a second aspect the present invention provides a parachute toy as in the first aspect wherein the split sleeve member is releasably coupled to the carrier means by a frictional engagement between the outer engagement surfaces of the carrier means and internal engagement surfaces of the split sleeve member, the engagement being sufficient to withstand wind forces acting on the parachute while the parachute is drawing the carrier means and weight means up the kite string but insufficient to hold the split sleeve member on the carrier means when the carrier means in arrested from further upward movement along the kite string by the stop means.

The present invention provides a novel split sleeve to couple a parachute to a carrier slidable up and down the kite string. The split sleeve can be coupled coaxially about the carrier which itself is coaxially about the kite string. By reason of a major slot through the split sleeve the split sleeve may be coaxially about the kite string yet release from the kite string when desired. The split sleeve is preferably adapted for frictional engagement onto the carrier but also readily adaptable to other release mechanisms triggering release upon contact of the upper end of the carrier with a stop on the kite string.

BRIEF DESCRIPTION OF THE INVENTION

Further objects and advantages of the invention will appear from the following description taken together with the accompanying drawings in which:

FIGS. 2, 3 and 5 are enlarged pictorial views of a split sleeve member, carrier member and stop, respectively, as provided in the embodiment of FIG. 1;

FIG. 4 is a cross-sectional view of the split sleeve member of FIG. 2 coupled onto the carrier member of FIG. 3; and FIG. 6 shows a modified figure in accordance with a second embodiment of the present invention.

DETAILED DESCRIPTION OF DRAWINGS

Figure 1:
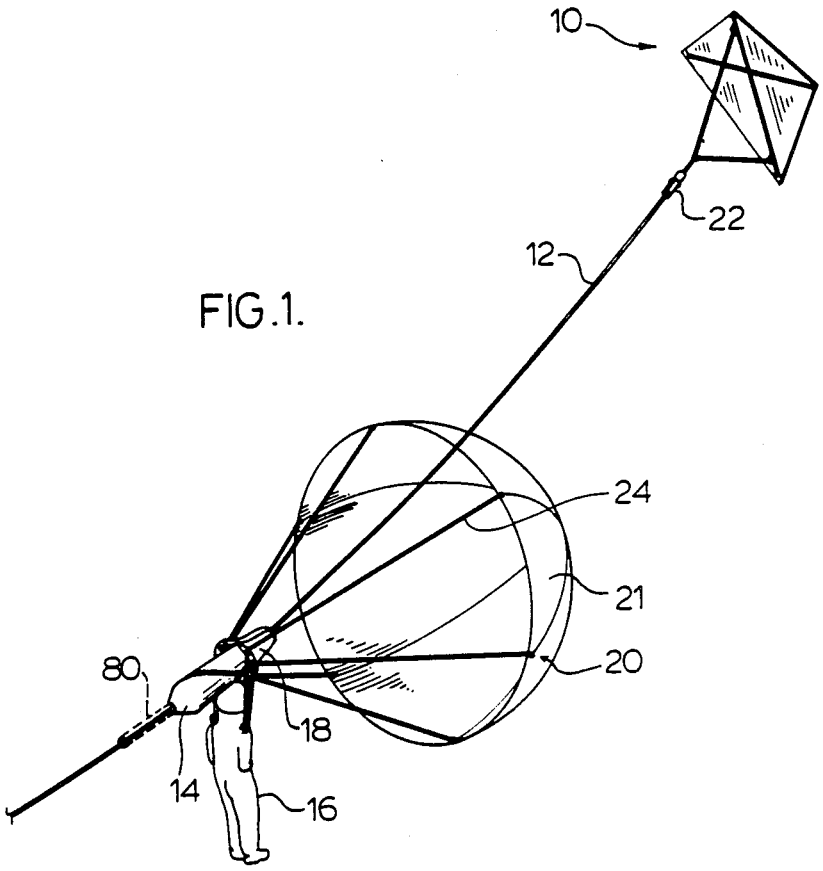
FIG. 1 is a pictorial view of a first embodiment of the toy parachute in accordance with the present invention as used on a conventional kite.
Figure 2:
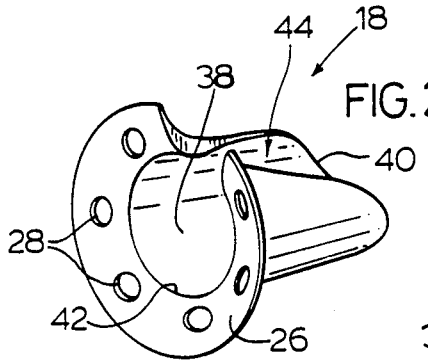

Reference is made first to FIGS. 1 and 2 showing a preferred embodiment of the present invention.

FIG. 1 shows a conventional kite 10 restrained in the wind by kite string 12 held at the ground by means typically a child, not shown. On kite string 12 there is shown a parachute toy comprising carrier 14, humanoid figurine 16, split sleeve 18, parachute 20 and stop 22. Parachute 20 has a canopy 21 and a plurality of shroud lines 24, each of which is secured to the canopy 21 at its upper end and to figurine 16 at its lower end. Split sleeve 18 is removably coupled to carrier 14. A lower, outwardly extending split flange 26 on split sleeve 18 has holes 28 therethrough spaced periperally about split sleeve 18 with one shroud line 24 passing through each hole 28.

With carrier 14 slidable on string 12, and with split sleeve 18 coupled to carrier 14, the wind force acting on parachute 20 draws the carrier, split sleeve, and figurine up string 12 to stop 22, where split sleeve 18 becomes released from carrier 14. The parachute then floats to the ground with split sleeve 18 and figurine 16 acting as its weight. Carrier 14 then slides down kite string 12.

As seen in FIG. 1, carrier 14 preferably is relatively elongate. An elongate opening 28 extends through the carrier from an upper end 30 to a lower end 32 of the carrier. Opening 28 receives kite string 14 so that carrier 14 may freely slide up and down kite string 14. While the kite string may merely be threaded through opening 28, a radially inwardly extending slot 34 may advantageously be provided through carrier 14 into opening 28 throughout its length. By providing slot 34 as a spiral or by suitably sizing slot 34, while the slot will permit entry of the string into and out of opening 28, the slot can be arranged to resist undesired removal of kite string 12 during use.

Carrier 14 has at its upper end 30 an external engagement surface 36 which preferably is disposed substantially coaxially about central opening 28 and is at least marginally frusto-conical tapering towards upper end 30.

Split sleeve 18 has an aperature 38 centrally therethrough open both at upper end 40 and lower end 42. A major slot 44 extends throughout the length of split sleeve 18 opening into aperature 38 from upper end 40 to lower end 42. The split sleeve down has a horizontal cross-section of annular, c-shape profile. Internal engagement surfaces 46 are defined inside the split sleeve complimentary to the external engagement surface 36 of carrier 14 so that the upper end 30 of carrier 14 may be forced up into aperature 38 with split sleeve 18 to become releasably coupled to carrier 14 by frictional engagement between external engagement surface 36 and internal engagement, surface 46.

Split sleeve 18 is shown with a split sleeve flange 26 extending outwardly therefrom at its lower end 42. Split flange 26 has a plurality of holes 28 spaced about its periphery with one of the shroud lines 24 passing through each hole so that split sleeve 18 is retained on the shroud line between parachute 20 and figurine 16 thereby effectively coupled to tthe figurine.

Major slot 44 of split sleeve 18 permits the split sleeve to be coupled to and uncoupled from carrier 14 while the carrier is slidably mounted on kite string 12.

Slot 44 permits kite string 12 to enter aperature 38 during coupling and to exit aperature 38 during uncoupling of split sleeve 18 from the carrier upon reaching stop 22. As a result of slot 44, split sleeve 18 and carrier 14 may slide coupled as a unit up the kite string both coaxially disposed about kite string 12 with the string passing centrally through opening 28 and aperature 38.

Stop 22 preferably is sized to be smaller than aperature 38 so that split sleeve 18 may pass upwardly over stop 22. Stop 22 is larger than opening 28 of carrier 14 so that the carrier can not slide on string 12 upwardly past the stop.

The stop preferably can be affixed to the string at any desired position. The stop is preferably of a simple construction as shown in FIG. 5 made from a straw-like hollow tube with a central, cut-away transverse slot 70 and a longitudinally extending slot having segments 72 and 74. By passing string about slot 70 then crossing the string ends over then passing them down through segments 72 and 74, a stop 22 can effectively be locked in one position. Many otehr stops may be provided such as two halves which snap together pinching the string therebetween.

The frictional engagement between engagement surfaces on carrier 14 and split sleeve 18 are selected so that having regard to the wind strength, the frictional engagement is sufficient to withstand wind forces acting on the parachute while the parachute is drawing the carrier upwardly on the string but insufficient to hold split sleeve 18 on carrier 14 arrested by stop 22.

Preferably split sleeve 18 is constructed from light weight plastic material or if metal with a thin wall so that the sleeve will be resilient and the frictional engagement between split sleeve 18 and carrier 14 may be varied by the extent to which the upper end of carrier 14 may be forced into the lower end of aperature 38. Carrier 14 may also be resilient to achieve a similar result, as for example, comprising elastically deformable plastic which may on radially inward compression compress to narrow slot 34.

Use of the toy with a kite will now be described. Stop 22 is attached to kite string 12. The kite string is placed inside opening 28 so the carrier is slidable on the string. Split sleeve 18 is coupled to carrier 14 by inserting the upper end of carrier 14 into aperature 38. With the kite flying, the canopy 21 of parachute 20 is permitted to fill with the wind and thereby draw the parachtue, split sleeve, figurine and carrier upwardly on the string to stop 22. On reaching stop 22, the upper end of carrier 14 engages the stop whereby further upward movement of carrier 14 is prevented. With carrier 14 stopped, wind forces are sufficiently strong to overcome the frictional engagement between carrier 14 and split sleeve 18 and the split sleeve releases from the carrier. The released split sleeve passes over stop 22 and disengages from about string 12 by the string passing out through slot 44. Subsequently the parachute free falls to the ground with its weight, namely split sleeve 18 and figurine 16 suspended below the open canopy. Carrier 14 slides down kite string 12.

Figure 3:
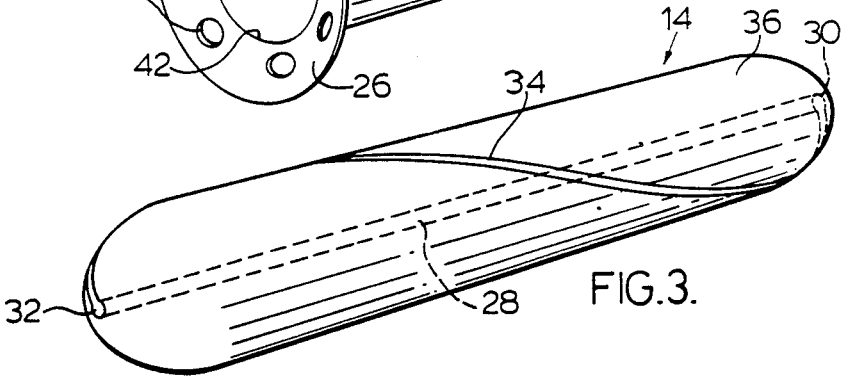

Reference is now made to FIG. 6 which shows a second embodiment of a weight for the parachute to be substituted for the split sleeve and figurine in FIG. 1. Parachute weight 52 shown comprises a toy figurine having a humanoid appearance with a head 54, body 56, arms 58 and 60, and legs 62. Shroud lines 24 are coupled proximate the head. Arms 58 and 60 extend arcuately outwardly from the body and away from each other then converge with their ends located close together yet spaced to form a slot 64 therebetween equivalent to slot 44 in FIG. 1. Inwardly directed portions 66 of the arms are formed to provide internal engagement surfaces similar to internal engagement surfaces 46 in FIG. 3. FIG. 52 may be coupled to carrier 14 by inserting the upper end of carrier 14 into the open ended aperature formed by the arms.

Carrier 14, split member 18 and the figurines 16 and 52 may comprise a light weight material such as plastic material and foamed plastic material.

FIG. 1 shows carrier 14 modified in dotted lines to have an integral extension 80 appearing as a slotted tube. By suitable selection of the length of extension 80, a number of carriers 14 can be used to raise a corresponding number of parachutes up the string at the same time. The length of the carriers provide spacing so that preceding parachutes are not in the wind shadow of subsequent parachutes. On upward movement of the carriers being stopped by the stop, each split sleeve will release. As slot 44 of the split sleeve is larger than the diameter of the extension 80 of each preceding carrier, the split sleeve of each subsequent carrier may escape from the string laterally over the preceding entension 80.

Split flange 26 of split sleeve 18 provides an advantage of keeping, via its holes 28, the shroud lines properly oriented to resist tangling. Prior to deployment, the split sleeve may be positioned close to the canopy so as to keep the same closed, as for example by pulling figurine 16 away from the split sleeve.

The internal surfaces 46 of split sleeve 18 are defined inside the split sleeve complimentary to the external engagement surface 36 of carrier 14. While the external engagement surfaces 36 are preferably frusto-conical tapering towards the upper end with internal engagement surfaces 46 preferably similarly frusto-conical tapering towards the upper end, many other configurations for both surfaces can be provided which will permit both the carrier and split sleeve to couple about the string.

In the figures, carrier 14 is shown with elongate opening 28 extending therethrough roughly coaxially within the outer surfaces of carrier 14. Elongate opening 28 need not be centrally within the carrier. Advantageously, in a carrier which is symmetrical about a central longitudinal axis passing therethrough, the opening may be located therein radially spaced from the axis so that the carrier will orientate itself on the kite string with the axis and center of mass below the string. Slot 34 may conveniently extend from the opening through the axis to the outer surface of the carrier and the propensity of the carrier to orientate itself with the axis below the string will assist in resisting undesired uncoupling of the carrier from the string.

The external engagement surfaces 36 may be coaxially disposed about either opening 28 or an axis of the carrier although neither is essential. The axis about which the frusto-conical surfaces 36 are disposed, the axis of the carrier and opening 28 may be coincident, parallel, or somewhat tilted with respect to each other, as is intended by the use of the wording that the split sleeve member may couple to the carrier "substantially coaxially thereabout".

In one preferred embodiment, the carrier may comprise a hollow thin walled tube with a straight elongate slot through the tube.

While the present invention has been described with reference to preferred embodiments, many modifications and varations willnow occur to those skilled in this art. For a definition of the invention, reference is made to the following claims.

What I claim is:

1. A parachute toy for being attached to a kite string and for, after travelling up said string with the wind, being released from said string for free flight to the ground, said toy comprising:

weight means, a parachute having a canopy and a plurality of shroud lines, said shroud lines being separately attached to said canopy at their upper ends and attached to said wieght means at their lower ends, carrier means having an elongate opening centrally therethrough to receive said kite string therein so that the carrier means is slidable up and down the kite string, the carrier means having at an upper end thereof external frusto-conical engagement surfaces disposed substantially coaxially about the opening and tapering towards the upper end, the weight means including a split sleeve member coupled thereto with an aperature centrally through the split sleeve member open at an upper end and at a lower end, a major slot through the sleeve member opening into the aperature throughout its length from said upper end to the lower end, internal frusto-conical engagement surfaces on the split sleeve member defining said aperature tapering toward the upper end complimentary to the external frusto-conical engagement surfaces on the carrier means, the split sleeve member adapted to releasably couple to the carrier means coaxially thereabout by insertion of the upper end of the carrier means into the lower end of the aperature so that the coupled carrier means and sleeve member as a unit may slide on the kite string disposed thereabout, the slot permitting passage of the kite string into the aperature on coupling of the split sleeve member to the carrier means and out of the aperature on uncoupling of the split sleeve member from the carrier means, stop means for attachment to the kite string at a desired height above the carrier means and sized to arrest upward movement of the carrier means yet permit upward movement of the split sleeve member therepast, the split sleeve member being releasably coupled to the carrier means by a frictional engagement between the outer engagement surfaces of the carrier means and internal engagement surfaces of the split sleeve member, said frictional engagement being sufficient to withstand wind forces acting on the parachute while the parachute is drawing the carrier means and weight means upwardly on the kite string but insufficient to hold the split sleeve member on the carrier means when the carrier means is arrested from further upward movement along the kite string by the stop means.

2. A toy as claimed in claim 1 wherein said split sleeve member has flange means extending outwardly therefrom about the lower end thereof, holes through the split flange means peripherally spaced thereabout, said shroud lines extending through said holes so that said split sleeve member is slidable on the shroud lines between the parachute and the remainder of the weight means and thereby coupled thereto.

3. A toy as claimed in claim 2 wherein said remainder of the weight means comprises a toy figurine having a humanoid appearance, said shroud lines coupled to said toy figurine.

4. A toy as claimed in claim 1 wherein said split sleeve member is resilient so that said frictional engagement may be varied by the extent to which the split sleeve member is forced onto the carrier means.

5. A toy as claimed in claim 1 wherein at least one of said split sleeve member and the upper end of the carrier means are resilient so that said frictional engagement may be increased by increasing forces with which the split sleeve member may be forced downward onto the carrier means.

6. A toy as claimed in claim 1 wherein said carrier means comprises an elongate member disposed coaxially about said opening.

7. A toy as claimed in claim 6 wherein said carrier means has a radially inwardly extending slot extending therethrough to the opening throughout its length to permit the kite string to be placed into and be removed from the opening for sliding of the carrier means thereon, said slot arranged on the carrier means to resist removal of the kite string from the opening.

8. A toy as claimed in claim 1 wherein said weight means comprises a toy figurine having a humanoid appearance with a head, a body, arms and legs, the shroud lines coupled to the figurine proximate the head, the split sleeve member being formed by the arms each extending outwardly away from the body and each other and then converging with ends thereof located close together yet spaced to form said slot therebetween, inwardly directed portions of the arms carrying said internal engagement surfaces.

9. A parachute toy for being attached to a kite string and for, after travelling up said string with the wind, being released from said string for free flight to the ground, said toy comprising:

weight means, a parachute having a canopy and a plurality of shroud lines, said shroud lines being separately attached to said canopy at their upper ends and attached to said weight means at their lower ends, carrier means having an elongate opening centrally therethrough to receive said kite string therein so that the carrier means is slidable up and down the kite string, the carrier means having at an upper end there of an outer engagement surface disposed substantially coaxially about the opening, the weight means including a split sleeve member coupled thereto with an aperature centrally through the split sleeve member open at an upper end and at a lower end, a major slot through the sleeve member opening into the aperature throughout its length from said upper end to the lower end, internal engagement surfaces on the split sleeve member defining said aperature, the split sleeve member adapted to releasably coupled to the carrier means coaxially thereabout by insertion of the upper end of the carrier means into the lower end of the aperature so that the coupled carrier means and split sleeve member as a unit may slide on the kite string disposed thereabout, the slot permitting passage of the kite string into the aperature on coupling of the split sleeve member to the carrier means and out of the aperature on uncoupling of the split sleeve of the split sleeve member from the carrier means, stop means for attachment to the kite string at a desired height above the carrier means and sized to arrest upward movement of the carrier means yet permit upward movement of the split sleeve member therepast, the split sleeve member being releasably coupled to the carrier means by a frictional engagement between the outer engagement surface of the carrier means and internal engagement surfaces of the split sleeve member, said frictional engagement being sufficient to withstand wind forces acting on the parachute while the parachute is drawing the carrier means and weight means up the kite string but insufficient to hold the split sleeve member on the carrier means when the carrier means is arrested from further upward movement along the kite string by the stop means.

10. A parachute toy for being attached to a kite string and for after travelling up said string with the wind, being released from said string for free flight to the ground, said toy comprising:

weight means, a parachute having a canopy and a plurality of shroud lines, said shroud lines being separately attached to said canopy at their upper ends and attached to said weight means at their lower ends, carrier means having an elongate opening therethrough to receive said kite string therein so that the carrier means is slidable up and down the kite string, the carrier means having at an upper end thereof an external frusto-conical engagement surface disposed about the opening and tapering towards the upper end, the weight means including a split sleeve member coupled thereto with an aperature centrally through the split sleeve member open at an upper end and at a lower end, a major slot through the sleeve member opening into the aperature throughout its length from said upper end to the lower end, internal frusto-conical engagement surfaces on the split sleeve member defining said aperature, tapering toward the upper end and complimentary to the external frusto-conical engagement surface on the carrier means, the split sleeve member adapted to releasably couple to the carrier means coaxially thereabout by insertion of the upper end of the carrier means into the lower end of the aperature so that the coupled carrier means and sleeve member as a unit may slide on the kite string disposed thereabout, the slot permitting passage of the kite string into the aperature on coupling of the split sleeve member to the carrier means and out of the aperature on uncoupling of the split sleeve member from the carrier means, stop means for attachment to the kite string at a desired height above the carrier means sized to arrest upward movement of the carrier means yet permit upward movement of the split sleeve member therepast, the split sleeve member releasably coupled to the carrier means for release upon contact of the carrier means with the stop means.

* * * * *